US006702421B2

(12) United States Patent
Inui et al.

(10) Patent No.: US 6,702,421 B2
(45) Date of Patent: Mar. 9, 2004

(54) INK JET PRINTING APPARATUS, RECOVERY DEVICE IN INK JET PRINTING APPARATUS, AND RECOVERY METHOD IN INK JET PRINTING APPARATUS

(75) Inventors: Toshiharu Inui, Kanagawa (JP); Masaya Uetsuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/242,707

(22) Filed: Sep. 13, 2002

(65) Prior Publication Data

US 2003/0052938 A1 Mar. 20, 2003

(30) Foreign Application Priority Data

Sep. 18, 2001 (JP) ..... 2001-284037

(51) Int. Cl.[7] ..... B41J 2/165
(52) U.S. Cl. ..... 347/23; 347/7
(58) Field of Search ..... 347/5, 7, 14, 23, 347/29, 30, 35

(56) References Cited

U.S. PATENT DOCUMENTS 6,382,765 B1 5/2002 Kanda et al. ..... 347/23
6,536,865 B2 * 3/2003 Sarmast ..... 347/23

OTHER PUBLICATIONS

U.S. application No. 08/250,678, filed May 26, 1994 (Gotoh et al.).

U.S. application No. 09/845,285, filed May 1, 2001 (Inui et al.).

* cited by examiner

*Primary Examiner*—Huan Tran
(74) *Attorney, Agent, or Firm*—Fitzpatrick, Cella, Harper & Scinto

(57) ABSTRACT

A recovery method for an ink jet printing apparatus is provided which makes it possible to use as much ink in the ink tank as possible and minimize the residual ink volume at time of a tank replacement. The recovery method for keeping an ejection performance of the print head in appropriate condition by performing a recovery operation of discharging ink from the print head, therefore, includes the steps of: detecting a residual ink volume in the ink tank; and controlling a discharge ink volume to be discharged by the recovery operation when the residual ink volume detected by the residual ink volume detection step is less than or equal to a predetermined value.

9 Claims, 11 Drawing Sheets

INK JET PRINTING APPARATUS, RECOVERY DEVICE IN INK JET PRINTING APPARATUS, AND RECOVERY METHOD IN INK JET PRINTING APPARATUS

This application is based on Patent Application No. 2001-284037 filed Sep. 18, 2001 in Japan, the content of which is incorporated hereinto by reference.

BACKGROUND OF THE INVENTION

1. Field of the Invention

The present invention relates to an ink jet printing apparatus for printing an image by ejecting ink stored in an ink tank from a print head and to ink ejection performance recovery device and method for the ink jet printing apparatus. More specifically, the present invention relates to an improvement in a recovery operation performed to keep an ink ejection of the print head in an appropriate condition.

2. Description of the Related Art

In recent years, printers, facsimiles and copying machines using an ink jet printing system are rapidly expanding into the market.

Ink jet printing apparatus in general use have a print head for ejecting ink droplets and an ink tank for supplying ink to the print head. In one type of these ink jet printing apparatus which has a print head and an ink tank formed integral as one piece, when the ink tank runs out of ink, the print head as well as the ink tank must be replaced, increasing a consumption of consumable parts and therefore a running cost.

To deal with this problem, it is currently practiced to separately form a print head and an ink tank, removably assemble them together and mount them on a carriage. In this case, when the ink tank runs out of ink, only the ink tank needs to be replaced, significantly reducing the running cost when compared with the type in which they are formed integral as one piece. In the above construction having an integrally formed ink tank and print head, in further reducing the running cost it is effective to increase the capacity of the ink tank. Particularly, in a printer that prints a large number of sheets, such as a network printer in office, a problem may arise that unless a capacity of the ink tank or the number of sheets that can be printed with one ink tank is set large, a frequency at which the ink tank needs to be replaced will increase. It is therefore necessary to use a large capacity ink tank to reduce a burden of replacement work on the part of the user.

As the capacity of the ink tank increases, however, the carriage holding the print head and the ink tank also increases in size and weight. As the weights of the carriage and the ink tank increase, it becomes difficult to scan the carriage at high speed, rendering a high-speed printing difficult to achieve. Of course, the high-speed printing may be realized by using a high torque motor for driving the carriage but with an increased cost of the motor.

To cope with this problem, a printing apparatus has been put into practical use, in which only the print head is mounted in a carriage, with the ink tank fixed at a predetermined position on other than the carriage in the ink jet printing apparatus and connected to the print head as by a tube. In this apparatus, since what is mounted on the carriage is only a light-weight print head, the scanning of the carriage can be done at high speed without requiring a large motor. The capacity of the ink tank fixedly installed on other than the carriage can be selected appropriately by considering the running cost, the size of the apparatus and the frequency of ink tank replacement.

FIG. 10 is a conceptual diagram showing a printing apparatus having a print head and an ink tank connected through a tube.

Denoted 1 is a print head mounted on a carriage (not shown), 2 an ink tank, 3 a supply tube connecting the print head to the ink tank 2, and 4 an atmosphere-communication tube connected to the ink tank 2. When the print head 1 performs printing, ink in the ink tank 2 is supplied through the supply tube 3 to the print head 1. The same volume of air as the ink supplied to the print head 1 is introduced into the ink tank 2.

In the construction shown in FIG. 10, the ink tank mounted in the carriage is ideally replaced with a new one when the ink in the ink tank is completely used up. Replacing the ink tank at such a timing can be said to be ideal from the standpoint of an ink use efficiency in ensuring that the ink in the ink tank is completely consumed, and also from the standpoint of an ejection function in ensuring that air is not trapped into the tube by stopping the ink use just before the ink in the tube begins to be used. When air is trapped in the tube, the air will be taken into the print head as the print head continues printing, resulting in a failure to eject ink properly. It is therefore necessary to avoid the air being trapped into the tube.

Assuming that air may get trapped in the tube, it is possible to perform the recovery operation every time the ink tank is replaced In that case, there is a high possibility of unnecessary or redundant recovery operations being carried out, thus wasting the ink and time. During the recovery operation all the ink in the tube and the print head needs to be sucked out and removed, and thus a large volume of ink is consumed. When the above-described excess recovery operation is executed, a large amount of ink is wasted, increasing the running cost. Further, if the amount of ink discharged increases, a waste ink absorbing unit in the printing apparatus needs to be increased in capacity, which in turn leads to an unwanted increase in the overall size of the printing apparatus.

As described above, preventing air from being rapped in the tube is desirable also to make the recovery operation unnecessary after the replacement of the tank. For this purpose, detection means for detecting the amount of ink remaining in the ink tank needs to be provided.

Generally known residual ink volume detection means currently available include a discharge volume detection system that detects an ink discharge volume by counting the number of ink droplets ejected from a print head or metering an ink volume sucked out by recovery means, and a system that detects a residual ink volume by measuring a voltage change when a predetermined current is applied to a pair of electrodes installed in a tank.

Although the ink in the ink tank should be used up completely as described above, because it is impossible to determine what kind of image the user will print, it is necessary to stop using the ink tank just before the ink is consumed completely to allow a certain amount of ink to remain in the tank.

FIG. 11 shows a level of ink when the tank use is finished. For example, the residual ink volume detection means detects when the ink level reaches a position indicated by an arrow A in the figure, and decides that the ink tank has reached its final stage of use. At this time, the ink tank must contain a volume of ink that will allow a solid print image with a maximum print duty of 100% to be printed on a print medium of the largest size that can be used on the printing apparatus. If this volume of ink is not left in the tank, the ink in the tube may be consumed, causing air to enter into the tube.

When the final stage of tank use as indicated by the arrow A is reached, the ink tank must be replaced despite the fact that the tank still contains a certain volume of ink with which a low-duty printing can be performed. This is therefore not desirable from the standpoint of an ink use efficiency.

This is explained in more detail. In a printing operation that prints on, a print medium at a resolution or density of 600 pixels per inch with 30 picoliter of ink ejected to each pixel, for example, the amount of ink required to form a solid image of 100% print duty on a A3-size print medium is approximately 2 cc. Suppose that the amount of ink remaining in the tank when the residual ink level reaches the position of arrow A in FIG. 11 is 1 cc. In this condition, performing the above printing operation immediately before the ink level of arrow A is reached will cause the ink in the tube to be consumed and air to get into the tube. Thus, if a setting is made so that about 2 cc of ink remains when the ink level is at the arrow A position, i.e., at the final stage of tank use, the above problem is eliminated but the 2 cc of ink is wasted. This volume of ink wasted corresponds to 40 sheets of A4-size paper printed at a 5% duty.

Next, a recovery operation will be explained. The recovery operation involves operating a pump connected to a cap member adapted to engage the print head and generating a negative pressure in the cap to suck out ink from the print head. The amount of ink consumed by the recovery operation (discharge volume) can be set at an appropriate value according to a purpose of the recovery operation performed. For example, when several nozzles fail to eject ink or a printed image has light or dark strips or density variations, a recovery operation with a comparatively small ink consumption is executed. When air accumulated in the print head or tube is removed or when the printing apparatus has not been used for several weeks or months, a recovery operation with a comparatively large ink consumption is carried out. It is assumed here that the ink consumption by the latter recovery operation is 5 cc.

The final-stage-of-use position indicated by arrow A of FIG. 11 must be set so that the ink in the tube will not be consumed whichever recovery operation is executed. That is, the residual ink volume A needs to be set to 5 cc to accommodate a worst case in which a recovery operation with the largest ink consumption may be performed immediately before the arrow A position is reached. With this setting it is possible to reliably prevent the ink in the tube from being consumed by the recovery operation. However, when the residual ink volume reaches 5 cc after the normal printing operation, it is decided that the final stage of tank use is reached and thus the ink tank must be replaced. The 5 cc of residual ink is even larger than the residual ink volume set in the preceding case that allows the A3-size medium printing.

SUMMARY OF THE INVENTION

An object of the present invention is to provide an ink jet printing apparatus capable of using as much ink in an ink tank as possible and minimizing a residual ink volume at time of tank replacement.

According to a first aspect, the present invention provides an ink jet printing apparatus for performing a printing with a print head which ejects ink supplied from an ink tank, in the form of droplets, the printing apparatus comprising: a print head for ejecting ink droplets; an ink tank for storing ink to be supplied to the print head; recovery means for keeping an ejection performance of the print head in appropriate condition by discharging ink from the print head; a residual ink volume detection means for detecting a residual ink volume in the ink tank; and a discharge ink volume control means for controlling a discharge ink volume to be discharged by the recovery means when the residual ink volume detected by the residual ink volume detection means is less than or equal to a predetermined value.

In the above aspect, the ink tank may be connected to the print head through a predetermined ink supply path.

Further, the discharge ink volume control means may set two or more discharge ink volumes to be discharged by the recovery means.

Further, the recovery means may be able to perform a plurality of recovery operations with different discharge volumes and the control means may select one of the recovery operations according to the residual ink volume in the ink tank.

Further, the recovery means may include a cap that hermetically contacts an ink nozzle surface of the print head and pressure generation means connected to the cap, and a negative pressure generated by the pressure generation means may be applied to an interior of the cap in hermetic contact with the ink nozzle surface of the print head to discharge ink from the nozzles.

Further, the residual ink volume detection means may comprise metering means for measuring an ink volume flowing out of the print head and calculation means for determining the residual ink volume by subtracting the ink volume measured by the metering means from a maximum storage volume of the ink tank.

Further, the residual ink volume detection means may comprise a pair of electrodes provided on a bottom of the ink tank, an annular wall enclosing at least one of the electrodes, a constant current source for applying a constant current between the electrodes through the ink and a voltage detection means for detecting a voltage between the electrodes, and detect the residual ink volume from the voltage detected by the voltage detection means.

According to another aspect, the present invention provides a recovery device in an ink jet printing apparatus, wherein the ink jet printing apparatus has a print head for ejecting ink droplets and an ink tank for storing ink to be supplied to the print head, the recovery device comprising: recovery means for keeping an ejection performance of the print head in appropriate condition by discharging ink from the print head; a residual ink volume detection means for detecting a residual ink volume in the ink tank; and a discharge ink volume control means for controlling a discharge ink volume to be discharged by the recovery means when the residual ink volume detected by the residual ink volume detection means is less than or equal to a predetermined value.

According to still another aspect, the present invention provides a recovery method used in an ink jet printing apparatus for keeping an ejection performance of a print head in appropriate condition by performing a recovery operation of discharging ink from the print head, wherein the ink jet printing apparatus has the print head for ejecting ink droplets and an ink tank for storing ink to be supplied to the print head, the recovery method comprising the steps of: detecting a residual ink volume in the ink tank; and controlling a discharge ink volume to be discharged by the recovery operation when the residual ink volume detected by the residual ink volume detection step is less than or equal to a predetermined value.

In the invention having the construction described above, since the ink consumption by the recovery operation is limited according to the residual ink volume in the ink tank, the residual ink volume at the end of use of the ink tank can be reduced significantly, thus making an efficient use of the ink.

The above and other objects, effects, features and advantages of the present invention will become more apparent from the following description of embodiments thereof taken in conjunction with the accompanying drawings.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described by referring to the accompanying drawings.

First, a construction of an ink jet printing apparatus according to one embodiment of this invention will be explained by referring to FIG. 1 to FIG. 5.

Figure 1:
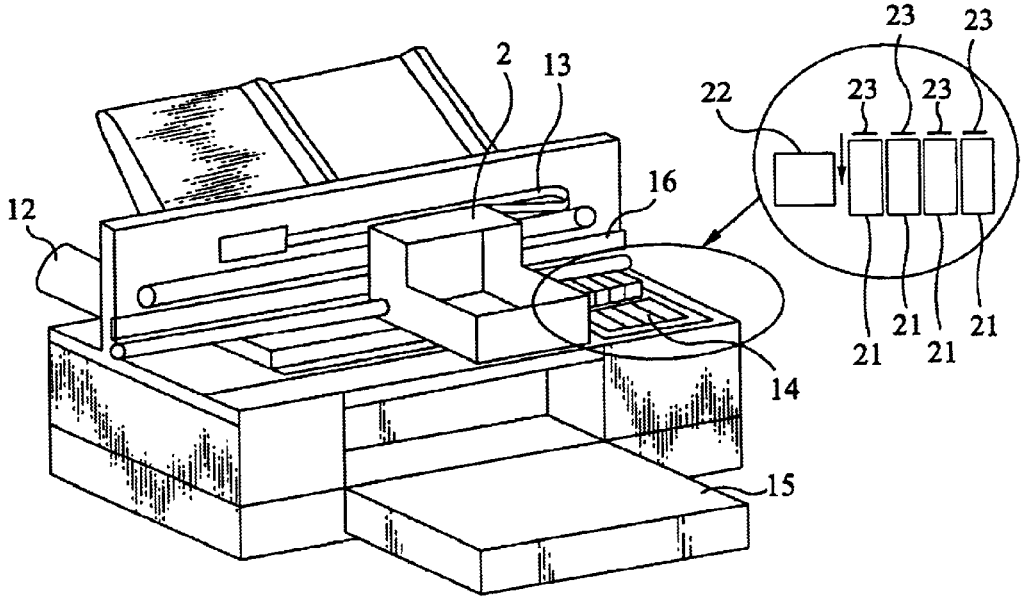
FIG. 1 is a perspective view showing an outline construction of an ink jet printing apparatus according to one embodiment of the present invention.

FIG. 1 is an external view showing essential portions of an ink jet printing apparatus (also referred to as a printer) that can apply the present invention This ink jet printing apparatus is of a so-called serial scan type in which an image is formed on a print medium (also referred to as print paper or simply paper) by ejecting ink from an ink jet print head according to image data as the print head is reciprocally moved in a main scan direction perpendicular to a sub-scan direction in which the print medium is fed, and by intermittently feeding the print medium in the sub-scan direction.

This ink jet printing apparatus includes a carriage 2 mounting the ink jet print head (also referred to simply as a print head), a carriage motor 12 for driving the carriage 2 in the main scan direction, a flexible cable 13 for transmitting electric signals from a control unit (not shown) held in the printing apparatus body to the print heads recovery means 14 for recovering an ink ejection performance of the print head, a paper supply tray 15 for storing print mediums in a stacked state, and an optical position sensor 16 for optically reading a position of the carriage 2.

In the ink jet printing apparatus of such a construction, the print head along with the carriage 2 is serially scanned over the print medium to perform printing over a linne of a width corresponding to the number of nozzles of the print head and, during a non-printing operation, the print medium is fed a predetermined distance.

Further, in an enlarged plan view of the recovery means 14 in FIG. 1, denoted 21 is suction and rest caps, 22 an ink receiver for receiving ink ejected during the ejection performance recovery operation, and 23 wiper blades for wiping a nozzle face of each head. The wiper blades 23 are moved in a direction of arrow to wipe the nozzle faces.

In this embodiment, the nozzles of the print head are hermetically enclosed by the caps 21 and a suction pump (not shown) as pressure generating means connected to the caps 21 is operated to generate a negative pressure in the caps 21 and thereby suck out ink from the nozzles of the print head. This recovery means can perform three kinds of recovery operations. When several nozzles fail to eject ink or a printed image has light or dark strips or density variations, a recovery operation with a comparatively small ink consumption is performed. This recovery operation is called a recovery operation A When air accumulated in the print head or tube is removed or when the printing apparatus has not been used for several weeks or months, a recovery operation with a comparatively large ink consumption is carried out. This recovery operation is called a recovery operation B. Further, when the printing apparatus is newly installed or the print head is replaced, or when the printing apparatus has not been used for a long period of time in excess of several months, a recovery operation with the largest ink consumption is executed. This recovery operation is called a recovery operation C. Here, the recovery operation A consumes 0.5 cc of ink, the recovery operation B consumes 4 cc and the recovery operation C consumes 7 cc.

Figure 2:
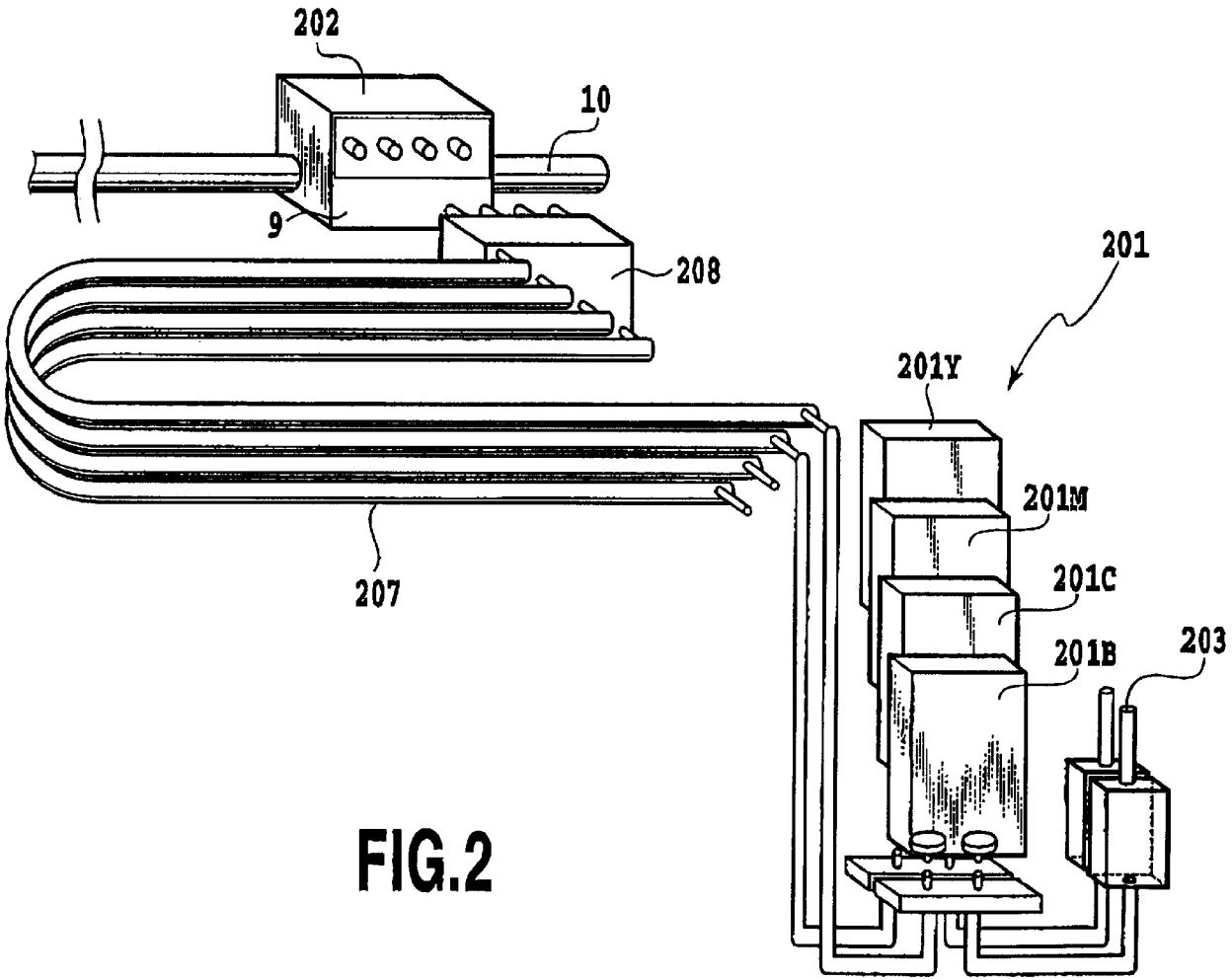
FIG. 2 is a schematic diagram showing an outline construction of an ink supply system in one embodiment of the invention.

FIG. 2 is a diagram showing a printing apparatus in which print head and ink tanks are connected with tubes.

Ink is supplied from a main ink tank 201 through tubes 207 and a joint 208 to a sub-ink tank 202 on the carriage 2 from which it is further supplied to the print head 9 In the main ink tank 201, denoted 201Y, 201M. 201C and 201B are ink tanks for yellow, magenta, cyan and black inks, respectively. The print head 9 is moved together with the carriage 2 in the main scan direction along the shaft 10. Designated 203 is a buffer chamber.

The ink may be directly supplied to the print head 9 from the main tank 201 installed at a fixed position in the apparatus body. However, to minimize a load on the carriage 2 for higher printing speed and lighter weight, it is effective to reduce the size of the sub-tank 202 mounted on the carriage 2, as in this embodiment. That is, in this embodiment the sub-tank 202 of relatively small capacity is mounted on the carriage 2 to supply ink to the print head 9 from the sub-tank 202, which in turn is supplied ink from the main tank 201 of relatively large capacity installed at a fixed position in the apparatus body. The supply joint 208 forms an ink supply path between the main tank 201 and the sub-tank 202 when the carriage 2 moves to a predetermined position such as home position. Thus, at an optimum timing according to the capacity of the sub-tank 202 and the ink consumption of the print head 9, the ink can be supplied from the main tank 201 to the sub-tank 202. In this embodiment an Ink volume of the main tank is set at 80 cc.

Next, an electric circuit configuration according to one embodiment of this invention will be explained.

Figure 3:
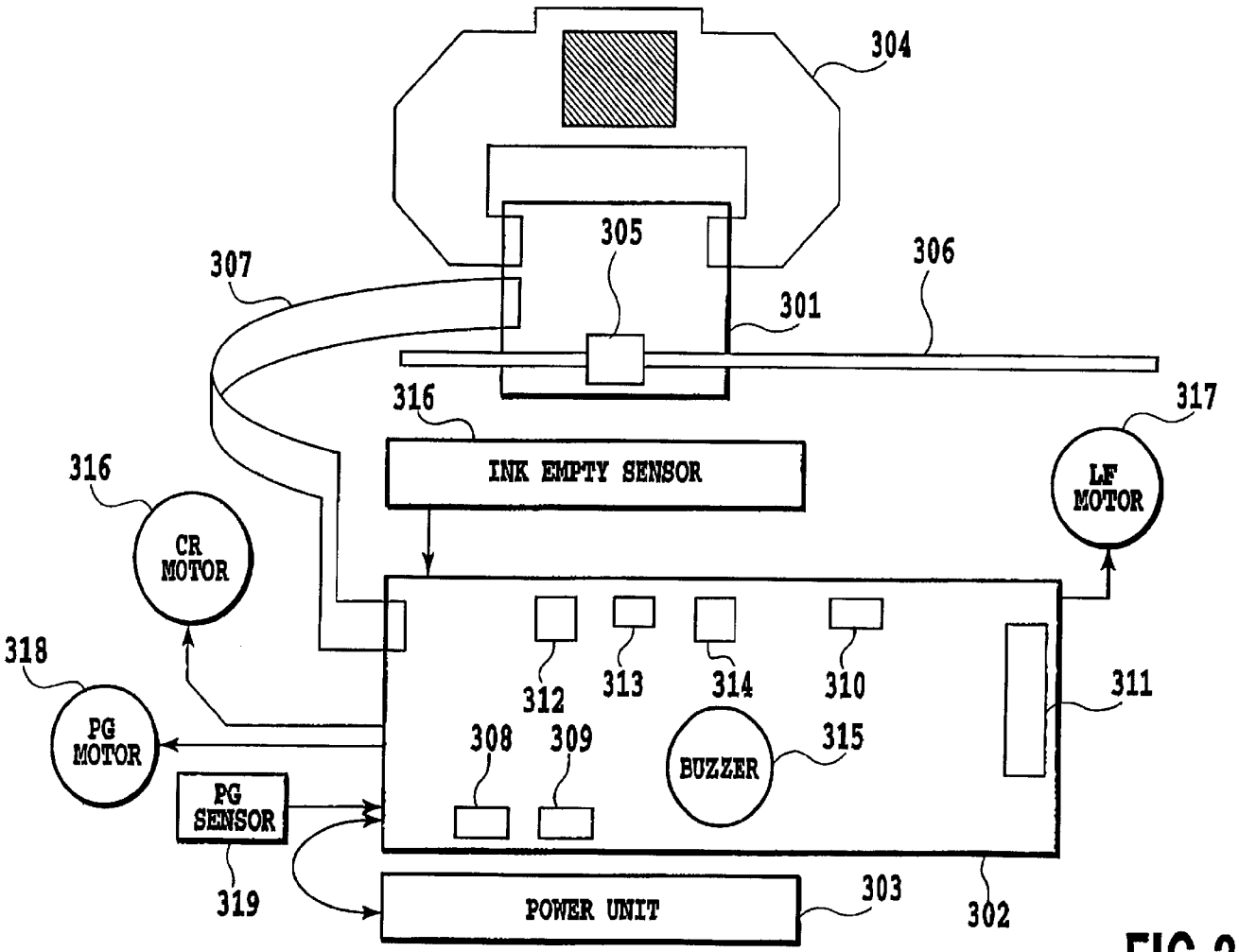
FIG. 3 is a schematic diagram showing an overall configuration of an electric circuit in one embodiment of the invention.

FIG. 3 is a schematic diagram showing an overall configuration of an electric circuit in one embodiment. A control system in this embodiment includes mainly a carriage printed circuit board 301, a main PCB (printed circuit board) 302, and a power unit 303. The power unit is connected to the main PCB 302 and supplies a variety of drive powers. The carriage PCB 301 is a printed circuit board unit mounted on the carriage 2 (FIG. 1) which functions as an interface for sending and receiving signals to and from the print head through a contact PFC 304 and which, based on pulse signals output from an encoder sensor 305 as the carriage is scanned, detects a change in a positional relation between an encoder scale 306 and the encoder sensor 305 and sends an output signal to the main PCB 302 through a flexible flat cable (CRFFC) 307.

The main PCB 302 is a printed circuit board unit that performs drive controls on various parts of the ink jet printing apparatus of this embodiment. The main PCB 302 has I/O ports for a paper end detection sensor (PE sensor) 308, an ASF sensor 309, a cover sensor 310, a parallel interface (parallel I/F) 311, a resume key 312, an LED 313, a power key 314 and a buzzer 315. It also is connected with a CR motor 316, an LF motor 317 and a PG motor 318 to control their operations and has connection interfaces with a PG sensor 319, the CRFFC 307 and the power unit 303.

Figure 4:
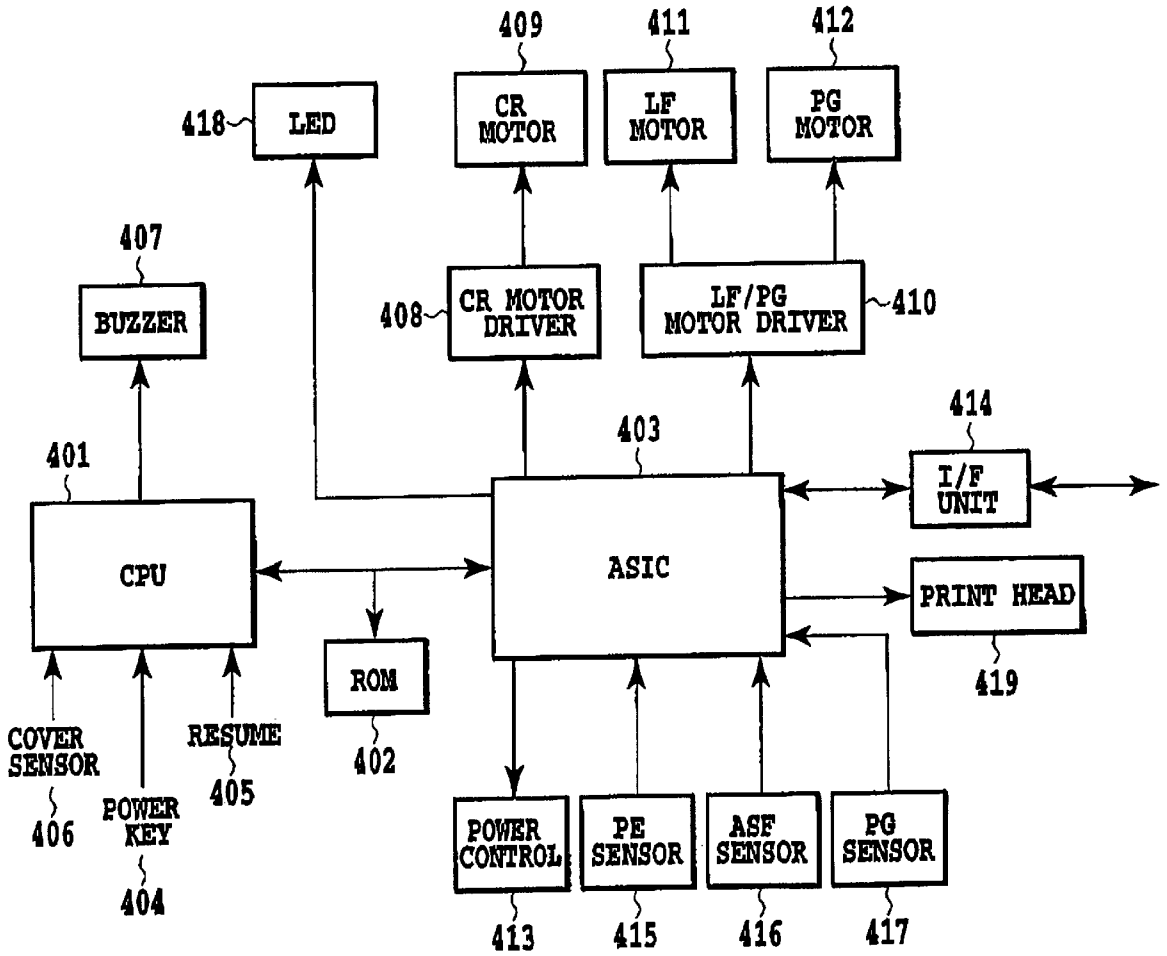
FIG. 4 is a block diagram of a main printed circuit board in one embodiment of the invention.

FIG. 4 is a block diagram of the main PCB in the printing apparatus of this embodiment. In the figure, designated 401 is a CPU which is connected to a ROM 402 and an ASIC (Application Specific Integrated Circuit) 403 to control the ASIC 403 according to a program stored in the ROM 402 and also detects an input signal 404 from the power key 314, an input signal 405 from the resume key 312 and a cover detection signal 406. The CPU also drives the buzzer 407 using a buzzer signal (BUZ), detects a residual ink volume in the ink tank, performs various logic operations and judgments of conditions, and controls the driving of the print head and the ink jet printing apparatus.

Denoted 408 is a CR motor driver which, according to a CR motor control signal from the ASIC 403, generates a CR motor drive signal to drive a CR motor 409. Designated 410 is an LF/PG motor driver which, according to a pulse motor control signal (PM control signal) from the ASIC 403, generates an LF motor drive signal to drive an LF motor 411 and also generates a PG motor drive signal to drive a PG motor 412.

Designated 413 is a power control circuit which, according to a power control signal from the ASIC 403, controls power supply to various sensors having light emitting elements. A parallel I/F 414 sends a parallel I/F signal from the ASIC 403 to the parallel I/F cable connected to an external circuit. Signals from the parallel I/F cable are transferred to the ASIC 403.

This ASIC 403 is an one-chip semiconductor integrated circuit which is controlled by the CPU 401 through a control bus to output the CR motor control signal, PM control signal, power control signal, head power ON signal, motor power ON signal and others and transfer these signals to the parallel I/F 414. Further, the ASIC 403 checks statuses of a PE detection signal from a PE sensor 415, an ASF detection signal from an ASP sensor 416 and a PG detection signal from a PG sensor 417 and sends data representing the statuses of these signals to the CPU 401 through the control unit. The CPU 401, based on the received data, controls the operation of an LED drive signal to turn on or off an LED 418. Further, the ASIC 403 also has a dot count function, described later, which counts the number of ink droplets ejected from the print head 419.

Figure 5:
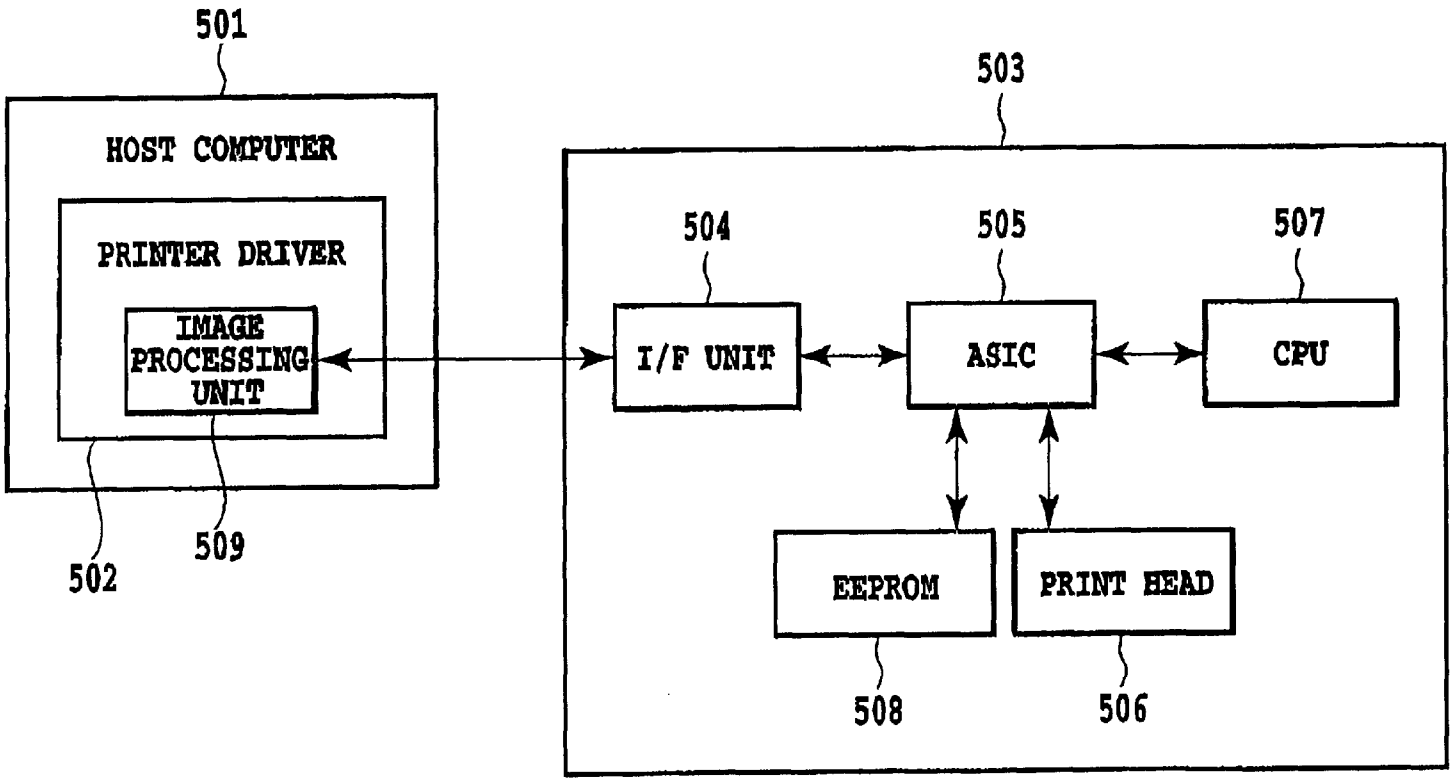
FIG. 5 is a block diagram showing a system configuration of a host computer and a printing apparatus in one embodiment of the invention.

FIG. 5 is a block diagram showing a concept of a system built from the ink jet printing apparatus and a host computer.

Denoted 501 is a host computer which is connected to the printing apparatus 503 and mainly generates data to be used for printing operation. Reference 502 represents a printer driver. In the host computer 501, image data supplied from an application program is sent from an image processing unit 509, described later, in the printer driver 502 to the printing apparatus 503. Through a two-way communication, the host computer receives from the printing apparatus 503 status information such as error data and head ejection volume information characteristic of this invention, and changes the processing method accordingly. The transfer and processing of these information will be detailed later.

An ASIC 505 sends and receives data to and from the host computer 501 through an I/F unit 504 in the printing apparatus 503. A CPU 507 sends and receives data signals and control signals to and from the ASIC 505 to control various operations of the printer 503. The ASIC 505 sends and receives head control signals to and from the print head 506. Further, the ASIC 505 has a dot counter (measuring means) to count the number of ink droplets ejected from the print head. The dot counter counts both the number of ink droplets ejected to form an image and the number of ink droplets ejected for a preliminary ejection to keep the ejection characteristic of the print head in appropriate condition. The CPU 507 receives the head control signals for the print head 506 through the ASIC 505 to perform a variety of controls for head driving. Further, the printing apparatus 503 has an EEPROM 508, and the content of the EEPROM 508 is transmitted to the CPU 507 through the ASIC 505 at a predetermined timing.

As a method of detecting the residual ink volume in the ink tank, this embodiment employs a dot count method using the dot counter. This method involves counting the number of ink droplets ejected for forming an image and for performing the preliminary ejection, multiplying the counted value by the ink volume (discharge volume) for each droplet to determine an ink consumption and subtracting the calculated ink consumption from the full volume of ink in the ink tank to determine a residual ink volume in the tank. At this time, an ink volume consumed by the recovery operation is also considered in addition to the number of ink droplets ejected from the print head to determine the residual ink volum.

Next, a control operation in one embodiment of this invention executed by the ink jet printing apparatus of the above construction will be described.

(First Embodiment)

Figure 6:
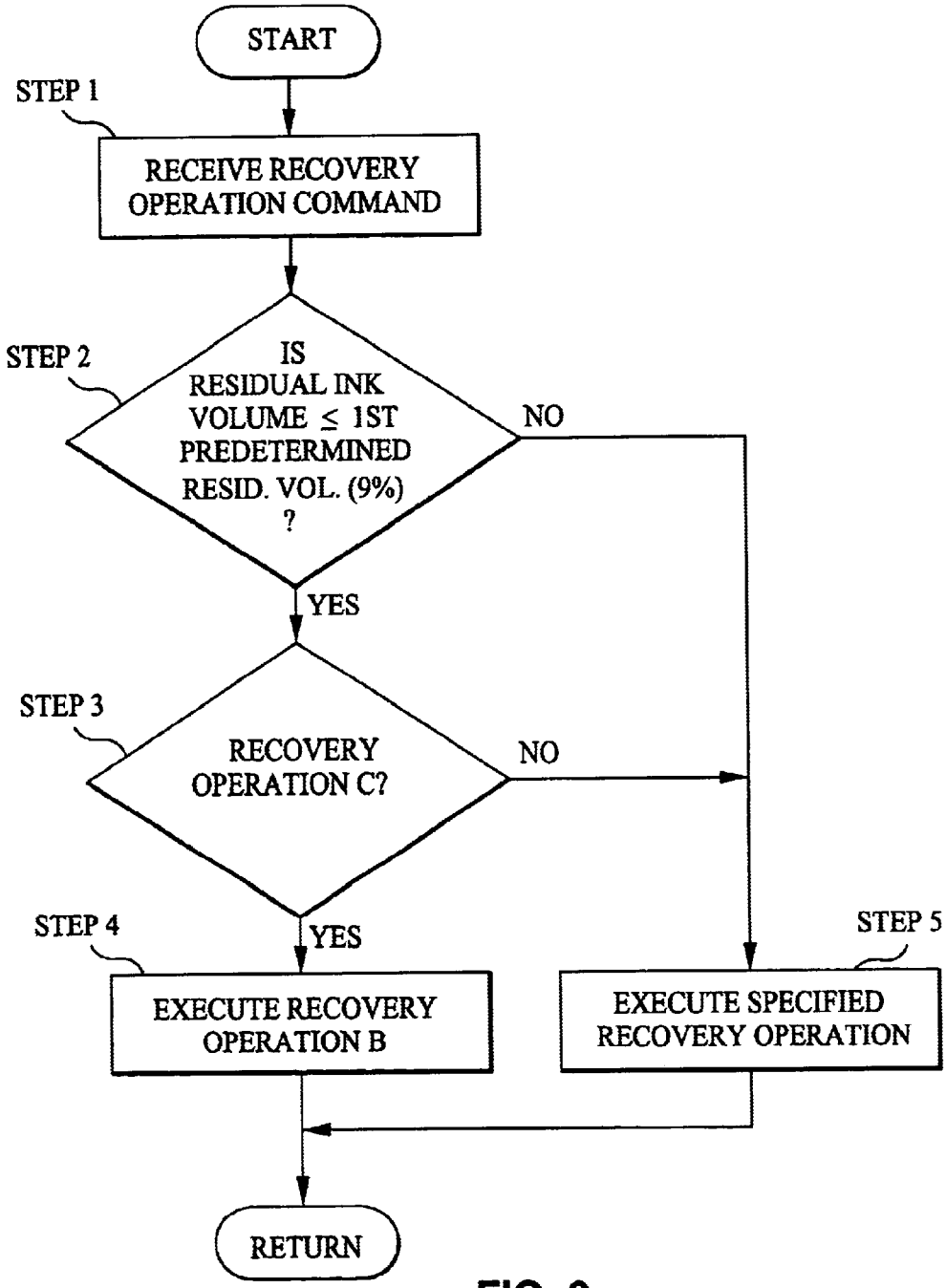
FIG. 6 is a flow chart showing a control operation according to a first embodiment of the invention.

FIG. 6 is a flow chart showing a sequence of control operation performed in a first embodiment of this invention.

First, when a recovery operation command is received at step 1, the control sequence at step 2 checks whether the residual ink volume in the ink tank is less than or equal to a predetermined residual volume, which corresponds to 9% of the maximum storage volume of the ink tank. If the residual volume is not found less than or equal to the predetermined residual volume (9%), the control sequence performs the specified recovery operation at step 5.

If the residual ink volume is less than or equal to the predetermined residual volume, the control sequence at step 3 checks whether the recovery operation command received is for a recovery operation C. When it is determined to be the recovery operation C, step 4 executes a recovery operation B which consumes less ink than the recovery operation C.

When at step 3 the received recovery operation command is determined as not one for the recovery operation C, step 5 performs the specified recovery operation. In this case, the specified recovery operation is either a recovery operation A or B whose ink consumption is less than or equal to that of the recovery operation C, and is thus executed as specified.

In this first embodiment, the full ink volume of the ink tank is 80 cc, so that the specified residual volume of 9% corresponds to 7.2 cc. This specified residual volume (7.2 cc) is larger than the ink consumption of 7 cc by the recovery operation C. When the residual Ink volume becomes lower than 7.2 cc, the execution of the recovery operation C is inhibited and changed to the execution of the recovery operation B, as described above. Thus, the use of the ink tank can be terminated with only 4 cc of ink, which corresponds to the ink consumption by the recovery operation B, remaining in the tank. This arrangement can reduce the ink residual volume when compared with a case where the kinds of recovery operations are not limited.

(Second Embodiment)

Figure 7:
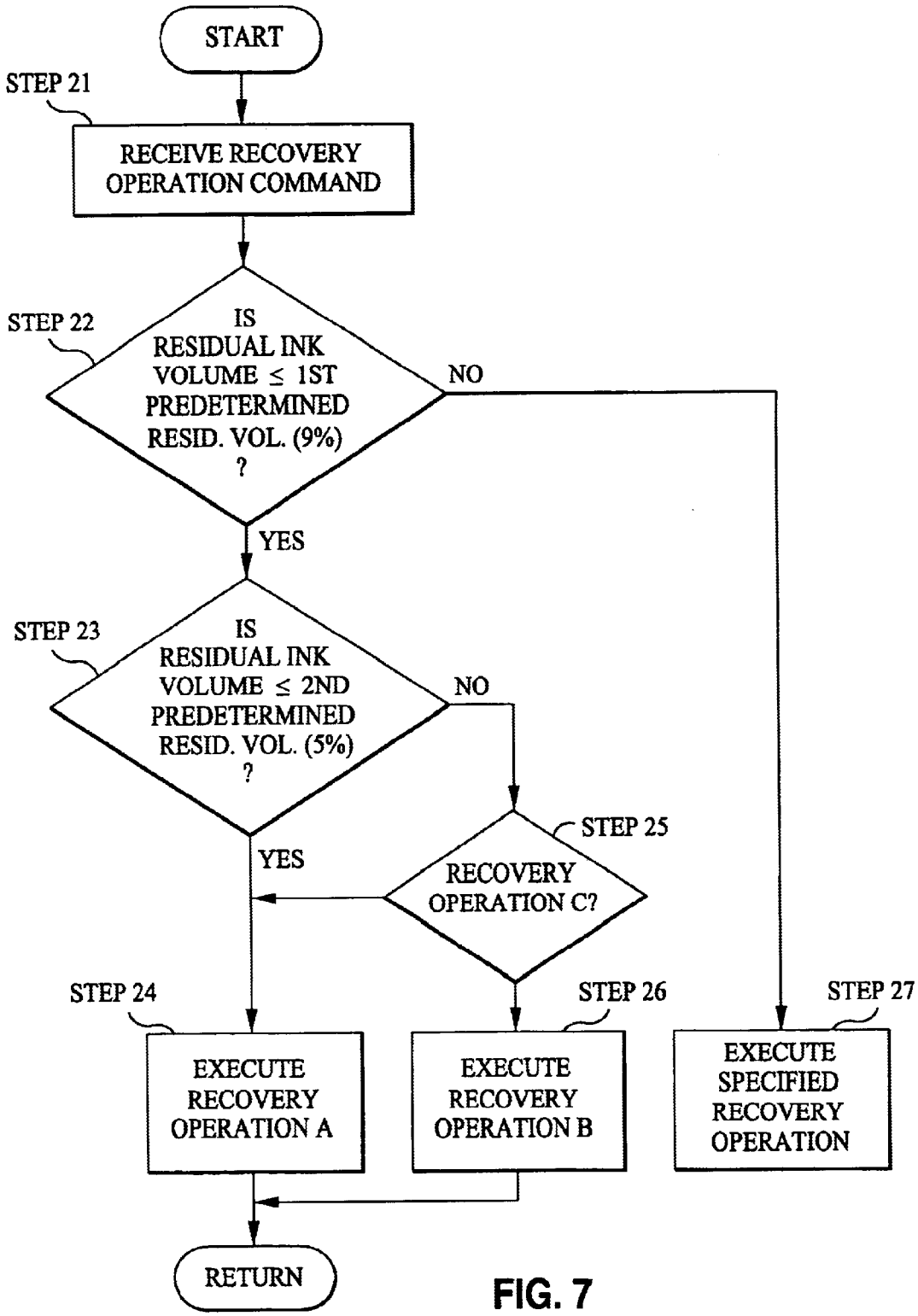
FIG. 7 is a flow chart showing a control operation according to a second embodiment of the invention.

FIG. 7 is a flow chart showing a series of control steps in a second embodiment of this invention.

First, a recovery operation command is received at step 21, the control sequence at step 22 checks whether the residual ink volume in the ink tank is less than or equal to a predetermined residual volume, which corresponds to 9% of the maximum storage volume of the ink tank. If the residual volume is not found less than or equal to the predetermined residual volume (9%), the control sequence performs the specified recovery operation at step 27.

If the residual ink volume is less than or equal to the predetermined residual volume, the control sequence at step 23 checks whether the residual ink volume is less than or equal to a second predetermined residual volume, which is 5% of the maximum storage volume of the ink tank. When it is decided that the residual ink volume is less than or equal to the second predetermined residual volume, step 24 executes the recovery operation A which consumes the least amount of ink. If at step 23 it is decided that the residual ink volume is not less than or equal to the second predetermined residual volume, the control sequence proceeds to step 25 where it checks whether the specified recovery operation is the recovery operation C. If it is decided that the recovery operation C is specified, the recovery operation B instead of the recovery operation C is executed. If it is decided that the recovery operation C is not specified, the control sequence proceeds to step 24 where it executes the recovery operation A.

As described above, in the second embodiment, when the residual ink volume is less than or equal to a first predetermined residual volume, the recovery operation B is executed even if the recovery operation C is specified. Further, when the residual ink volume is less than or equal to the second predetermined residual volume, the recovery operation A is executed whatever recovery operation is specified. In this second embodiment too, the first predetermined residual volume (9%) is 7.2 cc, which corresponds to the ink consumption by the recovery operation C. The second predetermined residual volume (5%) is 4 cc, which corresponds to the ink consumption by the recovery operation B.

Hence, if the use of the ink tank is stopped with 0.5 cc of ink, which corresponds to the ink consumption by the recovery operation A, remaining in the tank, then the minimum residual ink volume is 0.5 cc. This arrangement can further reduce the residual ink volume when compared with a case where the kinds of recovery operations are not limited. Considering the residual ink volume required to form an image, however, it Is preferred that a greater amount of ink than 0.5 cc be left in the tank. For example, when there is a possibility of printing a 100% solid image on an A3-size print medium, the use of the ink tank must be stopped when the residual ink volume reaches about 2 cc, as explained in connection with the prior art.

(Other Embodiments)

Generally, there are two kinds of recovery operations, one that is automatically performed by the printing apparatus to remove air trapped in the print head and tube or to remove viscous ink near the nozzles after the printing apparatus has been left unused for a comparatively long period of time, and one that is performed at the request of the user for some purpose.

Of these, the automatic recovery operation is normally preset with an execution timing and a frequency that are given predetermined allowances. Thus, when the residual ink volume in the ink tank is running low, limiting the recovery operation unconditionally as described in the preceding embodiments will rarely affect the image forming adversely. When the recovery operation is initiated by the user, however, there is a possibility that a recovery operation that may cause adverse effects on the image formation may be selected. But for the user to achieve his or her intended objectives, it is also effective to permit the user to choose a desired recovery operation. For this reason a mode may be provided which does not limit the recovery operation. In this case, however, there is a possibility of even the ink in the tube being consumed by the recovery operation initiated by the user. Thus, it is desired that the use of the ink tank be stopped somewhat earlier to avoid air entering the tube.

In the above embodiments the dot count system using a dot counter was employed to detect the residual ink volume. The residual ink volume detection means of this embodiment may use other systems than the dot count system. One such example is described below.

Figure 8:
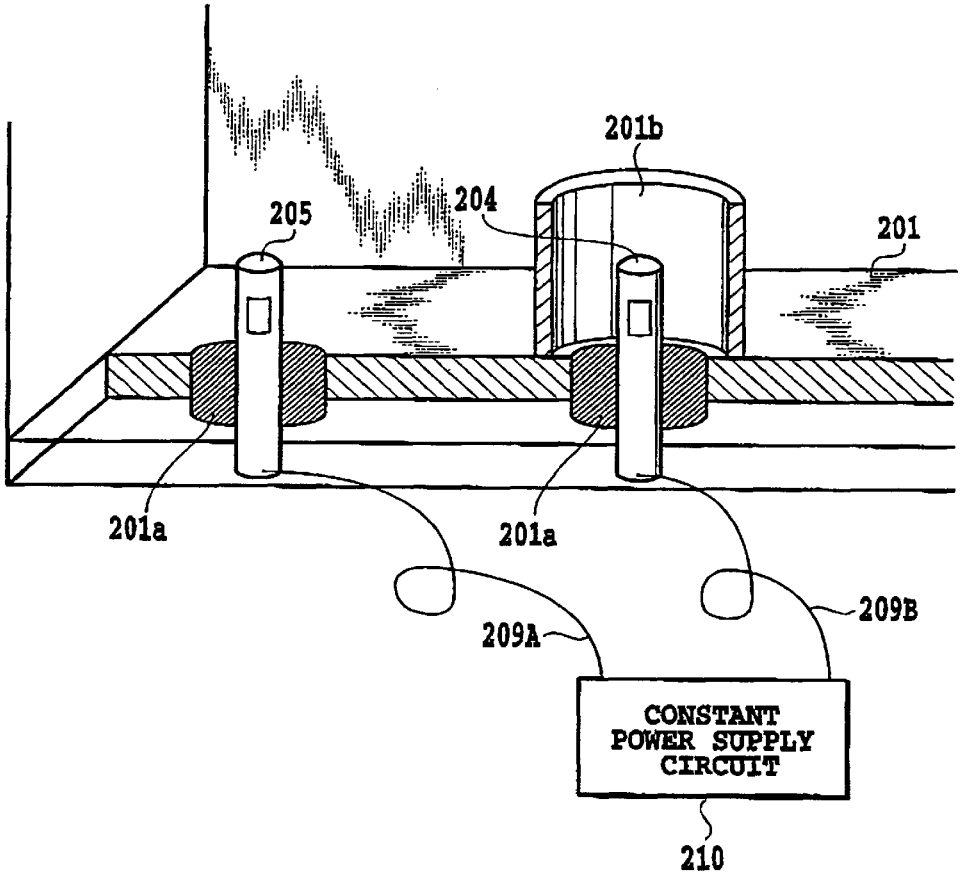
FIG. 8 is a schematic view showing another construction of the residual ink volume detection means in one embodiment of the invention.

FIG. 8 shows another example of the residual ink volume detection means applied to this invention. In the figure, a supply pin 205 and an atmosphere communication pin 204 are formed of conductive metal materials and are connected with one end of conductive wires 209A, 209B. These conductive wires 209A, 209B are connected at the other end to a constant current circuit (current source) 210. The constant current circuit 210 provides a DC current of 100 $\mu$A to produce a maximum voltage of 5 V between the pins 205 and 204 as electrodes.

Thus, when there is no ink in the tank 201 or when the tank 201 is not mounted in its place, the maximum voltage of 5 V is applied between these pins 205, 204. When the pins 205, 204 are electrically connected by the ink in the tank 201, the voltage applied between the pins 204, 205 changes according to a resistance of the tank 201. The residual ink volume detection means measures the amount of ink remaining in the tank 201 according to a change in the applied voltage.

Figure 9:
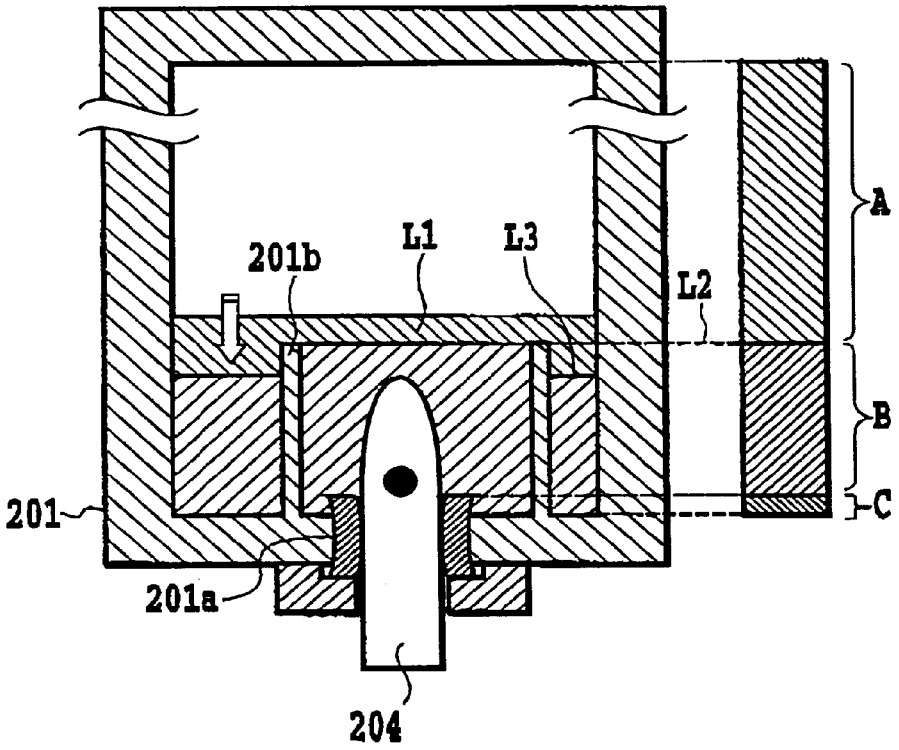
FIG. 9 is an explanatory vertical side cross section showing a working principle of the residual ink volume detection means of FIG. 8.
Figure 10:
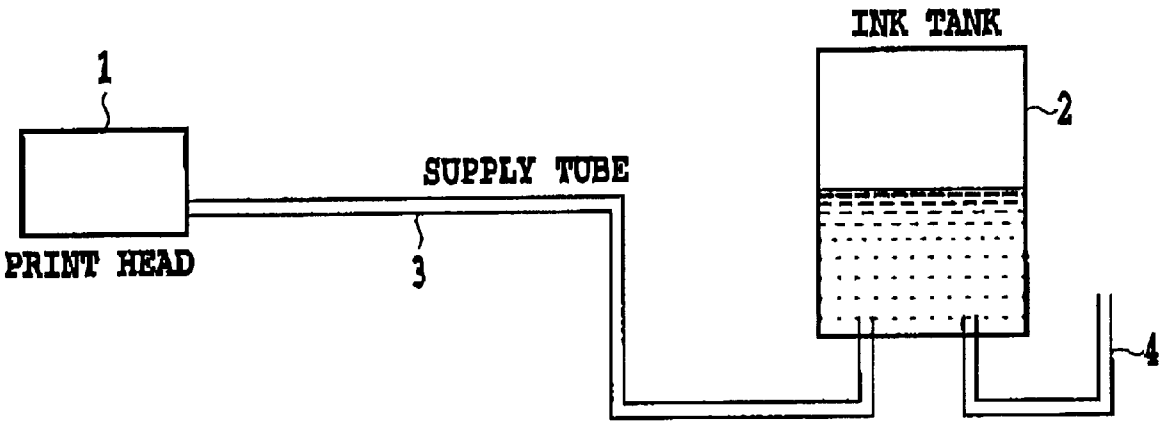
FIG. 10 is an explanatory schematic side view showing an ink supply system in the ink jet printing apparatus.
Figure 11:
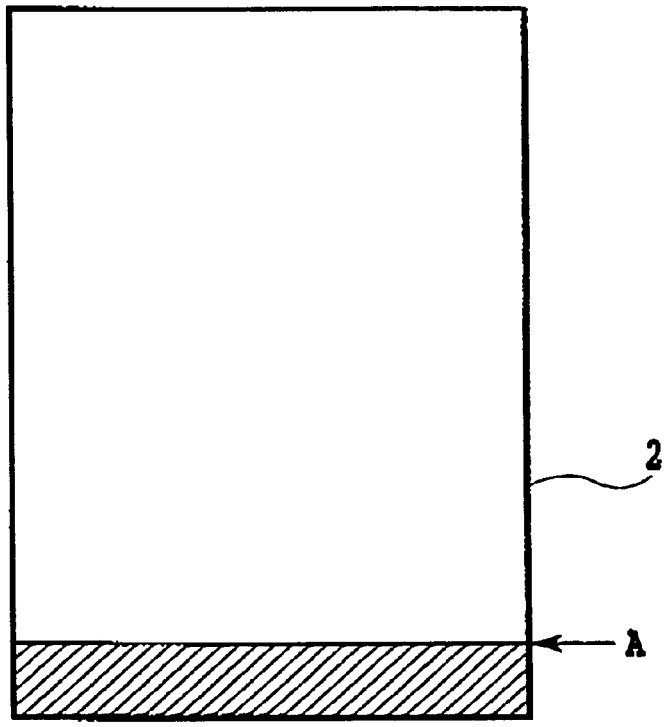
FIG. 11 is an explanatory schematic side view showing a volume of ink remaining in an ink tank when a final ink level set in the ink tank of the ink jet printing apparatus is reached.

FIG. 9 shows a detection principle of the residual ink volume detection means. The ink level in the tank 201 gradually lowers as the ink is consumed, as indicated by levels L1, L2, L3 in the figure. When the ink level is higher than an upper end of an annular wall 201*b* surrounding the atmosphere communication pin 204, as indicated by level L1, the atmosphere communication pin 204 and the supply pin 205, both functioning as electrodes, are electrically connected through the ink in the tank 201 that lies above the annular wall 201*b*.

When the ink level goes lower than the upper end of the annular wall 201*b*, as indicated by level L2, the annular wall 201*b* interrupts the electrical connection between the inside ink and the outside ink, thus electrically disconnecting the pins 204, 205.

Therefore, when the ink level reaches the upper end of the annular wall 201*b*, as shown at level L2, the applied voltage between the pins 204, 205 changes and the level L2 can be used as a detection point P. The residual ink volume detection means having a mechanism construction as described above detects from a voltage change when the ink level reaches the level L2.

As described above, in this embodiment any desired residual ink volume can be detected according to the height of the annular wall 201*b*.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus for performing a printing with a print head which ejects ink supplied from an ink tank in the form of droplet the ink Jet printing apparatus comprising:

recovery means for keeping an ejection performance of the print head in appropriate condition by discharging ink from the print head;

residual ink volume detection means for detecting a residual ink volume in the ink tank; and discharge ink volume control means for controlling a discharge ink volume to be discharged by the recovery means when the residual ink volume detected by the residual ink volume detection means is less than or equal to a predetermined value.

2. An ink jet printing apparatus according to claim 1, wherein the ink tank is connected to the print head through a predetermined ink supply path.

3. An ink jet printing apparatus according to claim 1, wherein the discharge ink volume control means sets two or more discharge ink volumes to be discharged by the recovery means.

4. An ink jet printing apparatus according to claim 1, wherein the recovery means can perform a plurality of recovery operations with different discharge volumes and the control means selects one of the recovery operations according to the residual ink volume in the ink tank.

5. An ink jet printing apparatus according to claim 1, wherein the recovery means has a cap that hermetically contacts an ink nozzle surface of the print head and pressure generation means connected to the cap, and a negative pressure generated by the pressure generation means is applied to an interior of the cap in hermetic contact with the ink nozzle surface of the print head to discharge ink from the nozzles.

6. An ink jet printing apparatus according to claim 1, wherein the residual ink volume detection means comprises metering means for measuring an ink volume flowing out of the print head and calculation means for determining the residual ink volume by subtracting the ink volume measured by the metering means from a maximum storage volume of the ink tank.

7. An ink jet printing apparatus according to claim 1, wherein the residual ink volume detection means comprises a pair of electrodes provided on a bottom of the ink tank, an annular wall enclosing at least one of the electrodes, a constant current source for applying a constant current between the electrodes through the ink and voltage detection means for detecting a voltage between the electrodes, and detects the residual ink volume from the voltage detected by the voltage detection means.

8. A recovery device in an ink jet printing apparatus for performing a printing with a print head which ejects ink supplied from an ink, in the form of droplets, the recovery device comprising:

recovery means for keeping an ejection performance of the print head in appropriate condition by discharging ink from the print head;

residual ink volume detection means for detecting a residual ink volume in the ink tank; and discharge ink volume control means for controlling a discharge ink volume to be discharged by the recovery means when the residual ink volume detected by the residual ink volume detection means is less than or equal to a predetermined value.

9. A recovery method used in an ink jet printing apparatus for keeping an ejection performance of a print head In appropriate condition by performing a recovery operation of discharging ink from the print head, wherein the ink jet printing apparatus performs a printing with a print head which ejects ink supplied from an ink tank, in the form of droplets, the recovery method comprising the steps of:

detecting a residual ink volume in the ink tank; and controlling a discharge ink volume to be discharged by the recovery operation when the residual ink volume detected by the residual ink volume detection step is less than or equal to a predetermined value.

* * * * *

UNITED STATES PATENT AND TRADEMARK OFFICE

CERTIFICATE OF CORRECTION

PATENT NO. : 6,702,421 B2
DATED : March 9, 2004
INVENTOR(S) : Inui et al.

It is certified that error appears in the above-identified patent and that said Letters Patent is hereby corrected as shown below:

Column 1,
Lines 27 and 37, “integral” should read -- integrally --.
Line 39, “cost” should read -- cost, --.

Column 2,
Line 37, “rapped” should read -- trapped --.

Column 3,
Line 7, “on,” should read -- on --.

Column 6,
Line 11, “linne” should read -- line --.
Line 31, “operation A” should read -- operation A. --.
Line 49, “head 9” should read -- head 9. --.

Column 7,
Line 5, “Ink” should read -- ink --.

Column 8,
Line 53, “volum.” should read -- volume. --.

Column 11,
Line 30, “droplet” should read -- droplets, -- and “Jet” should read -- jet --.

Column 12,
Line 41, “In” should read -- in --.

Signed and Sealed this

Fourteenth Day of December, 2004

JON W. DUDAS
*Director of the United States Patent and Trademark Office*